United States Patent [19]

Schramm

[11] Patent Number: 4,871,076

[45] Date of Patent: Oct. 3, 1989

[54] MODULAR SYSTEM FOR THE ERECTION OF DISPLAY APPARATUS

[75] Inventor: Werner Schramm, Munich, Fed. Rep. of Germany

[73] Assignee: PFP-Anstalt für Produktentwicklung und -Verwertung, Schaan, Fed. Rep. of Germany

[21] Appl. No.: 98,509

[22] Filed: Sep. 18, 1987

[30] Foreign Application Priority Data

Oct. 4, 1986 [DE] Fed. Rep. of Germany ..... 3633889
May 13, 1987 [DE] Fed. Rep. of Germany ..... 8706885

[51] Int. Cl.[4] ..... A47F 43/00
[52] U.S. Cl. ..... 211/189; 211/182
[58] Field of Search ..... 211/189, 206, 194, 193, 211/189, 182

[56] References Cited

U.S. PATENT DOCUMENTS 2,954,250 9/1960 Wing ..... 211/182 X
3,960,275 6/1976 Haughton et al. ..... 211/182
4,351,441 9/1982 Schramm ..... 211/182 X

FOREIGN PATENT DOCUMENTS 661864 7/1965 Belgium ..... 211/182
1128227 4/1962 Fed. Rep. of Germany ..... 211/182
1480683 5/1967 France ..... 211/182
445051 2/1968 Switzerland ..... 211/194

*Primary Examiner*—Sarah A. Lechok
*Attorney, Agent, or Firm*—Nils H. Ljungman

[57] ABSTRACT

A component system for the erection of display apparatus for merchandise consists of a column as the base element, which is formed by four round bars, which are fastened at an angular interval of 90 degrees on the circular circumference of perforated discs of the same diameter. The perforated discs are distributed at uniform intervals over the length of the column and are used to support fastener elements which can be adjustably fastened to round rods. Various fastener elements are described, which can be used to fasten merchandise racks, connecting elements or frame feed.

22 Claims, 6 Drawing Sheets

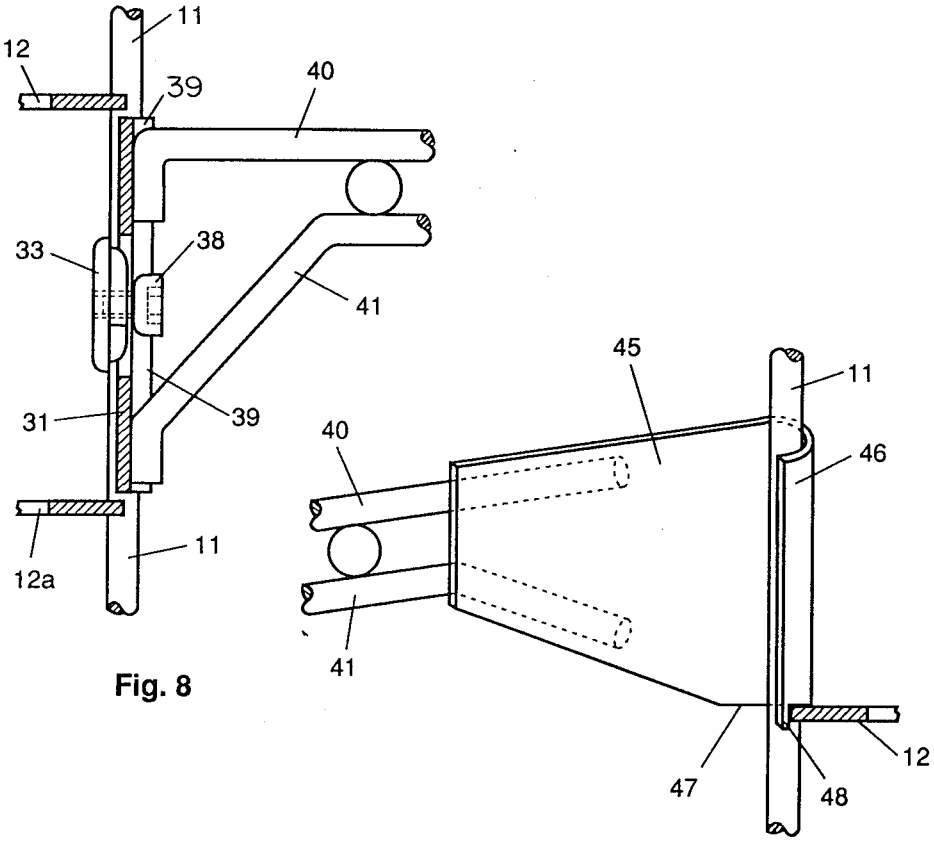
Fig. 9
Fig. 8
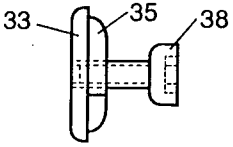
Fig. 6
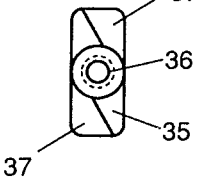
Fig. 7
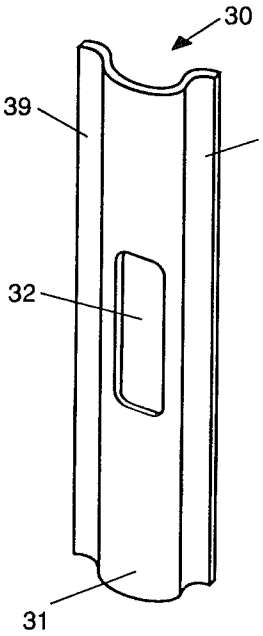
Fig. 5

MODULAR SYSTEM FOR THE ERECTION OF DISPLAY APPARATUS

BACKGROUND OF THE INVENTION

1. Field of the Invention:

This invention relates to a modular system for the erection of apparatus for the display of merchandise, consisting of one or more columns as the base element, with merchandise racks and/or connecting and support elements attached to it.

2. Description of the Prior Art:

Modular systems for the erection of display apparatus, either in the form of individual, free-standing racks or multi-segment display wall panels or display islands with a multi-sided configuration, are part of the prior art. As a rule, the wall-mounted base elements or the base frame elements comprise tubes with locator holes or slots so that merchandise racks or connecting elements, linear panels or partitions can be fastened on.

In such systems, the tubes used for the wall and frame elements must have a relatively large diameter to provide strength and stability, so that, display equipment usually appear to be heavy and bulky when placed in a relatively tight configuration.

To design display equipment so that it presents a light and airy appearance to the customer, the prior art also includes wire grid systems, whereby the wire grids must be relatively narrow to provide the required stability. This system, too, can only give the desired light and airy appearance in large showrooms if the individual display devices are not too close to one another or are not grouped too densely.

An alternative embodiment of the invention relates to a connecting element for supports and brackets, which preferably has four round rods, which are fastened preferably at 90 degree intervals along the circumference of perforated discs forming a rod bundle, whereby the ends of the round rods always project beyond the terminal perforated disc.

Rod bundles are part of the prior art for frames for the display of merchandise. To construct multi-purpose display equipment, it is desirable to be able to connect the rod bundles as supports and brackets in many different ways.

For framework connections, the prior art includes hexahedral nodes, into which rods can be inserted and preferably, screwed. The construction of such frameworks is relatively time-consuming, since the nodes are screwed together with the framework rods which are generally designed as tubes.

OBJECTS OF THE INVENTION

An object of the invention is to provide a modular system for the erection of display apparatus for merchandise, in particular, textile products, which has a very slim and elegant visual appearance, whereby the construction of the individual display devices in various configurations is made easy. In addition, color and lighting effects can be achieved without any adverse effect on the erection and usefulness of the individual merchandise racks or connecting elements and without detracting from the slim and elegant appearance.

A further object of the invention is to be able to construct framework structures of rod bundles, which can be rapidly and easily connected during erection, with the corresponding connecting elements in the form of polyhedrons. Such polyhedrons make it possible to erect individual rod bundles at right angles to one another and at an angle of 45 degrees to one another.

SUMMARY OF THE INVENTION

This object is achieved in one embodiment of the invention, in that, the column serving as the base element comprises four round bars, which are fastened at angular intervals of 90 degrees to the circular circumference of perforated discs having the same diameter. These perforated discs are distributed at uniform intervals over the length of the columns. The fastening of the merchandise racks and/or connecting elements or support elements to the columns is done by means of fastening elements, which are supported on at least one perforated disc, and can be oriented by installation on the round bars.

With such a design of a column as a base element, there are multi-faceted erection possibilities, whereby the column consisting of four round bars presents a very slender, light and elegant visual impression, and offers great stability. This impression can even be reinforced by introducing colored bars or strip lights into the column through the holes in the perforated discs without thereby detracting from the easy erection properties of the merchandise racks or the connecting elements.

Depending on the different types of merchandise racks and connecting elements, there are also different fastening elements to fasten the racks and connecting elements to the columns, which in a preferred embodiment, are provided with perforated discs at intervals of approximately 10 cm.

One embodiment of a fastener element related to merchandise racks or connecting elements or a frame foot consists of a contact plate and a clamp part which is engaged behind the round bars, and which can be bolted against the contact plate, whereby a stamping provided on the contact plate is engaged between two neighboring peripheral bars and is used both for stability and for the lateral orientation of the fastener element.

A simpler embodiment of an element to fasten lightweight merchandise racks to the column consists of a plate surrounding one round bar and connected with a merchandise rack or a connecting element, which, with its lower end surface, rests on the perforated disc and is engaged with a projection installed on the front edge of the circularly-bent part over the outer edge of the perforated disc.

To construct partitions or reflecting walls, the connecting element can also be designed as a panel, whereby the thickness of the connecting element corresponds to the lateral distance between two neighboring round bars, and a lateral extension of the edge can be inserted between two neighboring perforated discs.

For protection, the lateral extension inside the column is also provided with two holes, into which safety straps or locking pins can be inserted, which are in contact on the inside of the round bars.

Another embodiment of a simple fastening element consists of round bolts of different lengths running parallel to the longitudinal direction of the column, which can be inserted in the holes of two neighboring perforated discs from below and above, whereby a grid strap attached outside the column on the merchandise rack or the connecting element is in contact with two neighboring round bars from the outside.

For a particularly stable fastening of a connecting element with a contact plate, the contact plate is equipped with a U-shaped extension, which is in contact at least on top with the circumference of a perforated disc, and is engaged with the U-shaped extension between two neighboring round bars. In the base leg of the U-shaped extension, there is at least one hole to bolt the extension to the column.

Since it is desirable to attach rotating merchandise racks to such columns, the invention provides that the fastener element for rotating merchandise racks consists of a multi-segment cylinder sleeve provided with a support, whereby the individual parts of the sleeve are connected to one another in the vicinity of the round bars by means of film hinges.

Between each two neighboring film-type hinges, there is a projection, when the sleeve is installed, which extends over the perforated disc, and is in contact with it, which sleeve is then supported on the perforated discs.

The merchandise rack itself is provided with a cylindrical bushing which can be inserted over the cylinder sleeve and can be mounted on the latter so that it can rotate.

In another embodiment of the invention, a polyhedron is provided for the angular connection of rod bundles with at least six threaded holes distributed over the surface; the threaded holes run in three cutting planes perpendicular to one another, the outer end of the threaded hole ends in a fastening plane running perpendicular to it; the polyhedron has eight recesses lying between the fastening planes and matching the interval between the round rods of the rod bundle, to fasten a rod bundle, a cap screw is inserted in the threaded hold; the terminal perforated disc of the rod bundles lies in the fastening plane, whereby the ends of the round rods are engaged in the recesses; the perforated disc can be clamped with a profile engaged between the screw cap and the perforated disc.

Such a connecting element has the advantage that the individual cap screws can be inserted in the polyhedron in the desired position before erection, and that during assembly, the rod bundle, with the perforated disc, need only be pushed over the screw cap and can be clamped in place by means of a profile which can be inserted between the screw cap and the perforated disc.

To brace the perforated disc against the cap screw, the profile can be made of a U-shaped band material, against which the cap screw is tightened after insertion of the rod bundle.

The legs of the U-shaped band material can also be designed in the shape of a wedge. In this embodiment, the cap screw is inserted into the polyhedron at a certain distance, and the bracing is produced by driving in the wedge-shaped profile.

To fix the clamp distance for the wedging of the profile piece, the cap screw can also be provided with a collar at a distance from the screw cap which is in contact with the fastening plane.

Another embodiment of the invention provides that the polyhedron be provided, in each of the three cutting planes perpendicular to one another, with twelve additional fastening planes lying uniformly between the at least six other fastening planes, and that to fasten a rod bundle to the additional fastening planes between fastening plane and perforated disc, an intermediate cone can be inserted.

This intermediate cone at its smaller end can be made as one piece with a threaded stem, or it can be designed so that it can be pushed over a cap screw.

To fasten brackets to rod bundles of four round rods, the legs of a U-shaped rail are also bent outward at right angles in the center region, so that the U-shaped terminal segments of the rail are engaged between two neighboring round rods, whereby the center area bent outward at right angles is in contact from outside with the round rods, and so that a cap screw engaged through the base plate of the rail is engaged in a clamp which can be clamped from inside to the round rods. On such a connecting element, the bracket on the rail is rigidly fastened to it, or it can be suspended in the rail. For a further fastening of the bracket to the rail, the rail also has U-shaped segments on the top and bottom for the insertion of the bracket. There is also another fastening hole in the base plate through which the bracket can be clamped to the rail.

One aspect of the invention resides broadly in a modular system for the erection of apparatus for the display of merchandise. The modular system comprises at least one column for being received by a base, each at least one column having a longitudinal direction. One of each at least one column comprises a plurality of bars. A plurality of discs is disposed within and fastened to the bars. The bars are disposed about each disc substantially at equal angles one from the other. The plurality of discs are distributed along a length of one column. The one column has a longitudinal direction. The modular system further comprises at least one member chosen from the group consisting essentially of at least one merchandise display apparatus, and at least one connecting element for connecting the one column to another object, and an apparatus for connecting, the apparatus for connecting being at least for connecting the at least one member to the one column.

Another aspect of the invention resides broadly in a modular system which comprises at least one disc and also has four round bars disposed from one another about the at least one disc by angles of 90 degrees around the at least one disc, and a polyhedral shaped element which has a plurality of surfaces, the element having at least six threaded holes disposed on a plurality of the surfaces. The polyhedral shaped element defines three planes therein and are perpendicular to one another. The threaded holes have longitudinal axes. At least one of the threaded holes are disposed with its longitudinal axis in each of the three planes. Each threaded hole has an inner end and an outer end. The element has a surface substantially perpendicular to a corresponding one of each of the outer ends of each of the threaded holes. The polyhedral shaped element has eight recesses, four of each disposed adjacent each threaded hole and adjacent the surfaces at the outer end of each threaded hole. The bars are disposed a given distance one from the other. The eight recesses are disposed from one another at substantially the same distance as the given distance between the rods. At least one of the at least one disc has a hole in the center thereof. At least one cap screw is for insertion through the hole in the at least one disc and for insertion into one of the threaded holes. The rods extend beyond one of the at least one disc for engagement into four of the recesses of the polyhedral shaped element.

BRIEF DESCRIPTION OF THE DRAWINGS

FIG. 5 shows a contact plate.

FIG. 6 shows a lateral view of a clamp part.

FIG. 7 shows a clamp part in an overhead view on the clamp surfaces.

FIG. 8 shows a fastener element for the rigid connection of merchandise racks and connecting elements to the column.

FIG. 9 shows a fastener element for the suspension of merchandise racks and connecting elements in a modified form.

DESCRIPTION OF THE PREFERRED EMBODIMENTS

Figure 1:
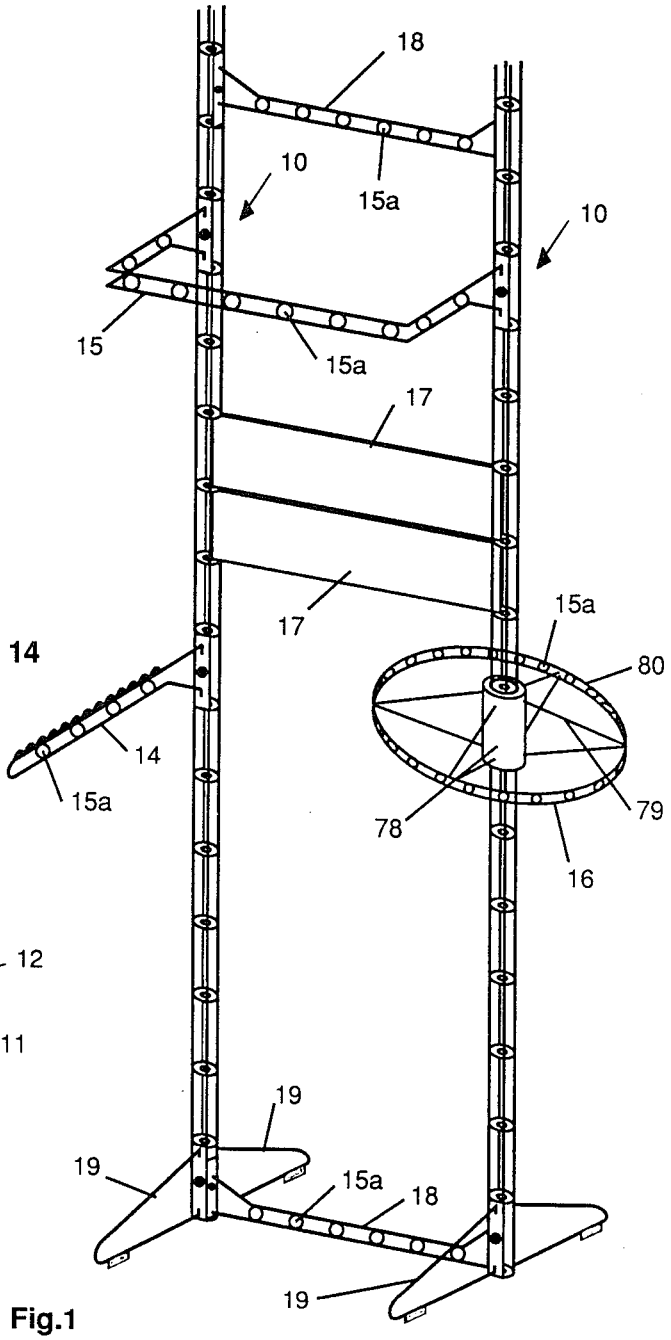
FIG. 1 shows a combined display apparatus with different merchandise racks and connecting elements.

The structure of a display rack illustrated in FIG. 1 is a demonstration model using two columns as the base element to which various merchandise racks and connecting elements have been attached.

Figure 2:
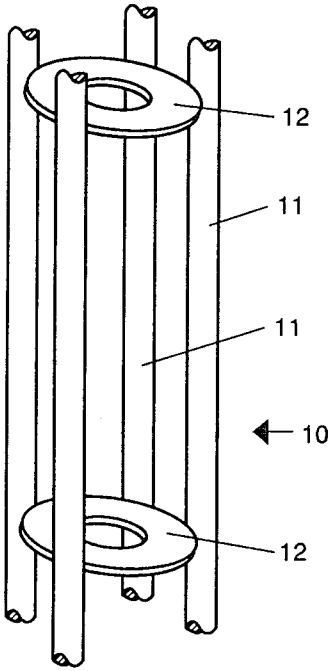
FIG. 2 shows a segment of the column used as the base element.

The column used as the base element is shown in cross section in FIG. 2 and consists of four round bars 11 which are welded to the outside circumference of perforated disc 12, specifically at an angular interval of 90 degrees, so that the line connecting the round bars forms a square.

The distance between the perforated discs is preferably 10 cm, which assures a very high stability and rigidity of the column, although the column does not appear bulky and clumsy.

FIG. 1 shows three different merchandise racks, whereby the merchandise rack 14 is designed as a one-arm, projecting merchandise rack, the rack 15 as a curved rack and the rack 16 as a rotating rack.

Two panels 17 are also shown, which can be used as connecting elements.

Other connecting elements 18 are shown at the top and bottoms ends. These connecting elements 18 and the merchandise racks 14, 15 and 16 comprise, in their basic models, of two round bars running parallel to one another, and held apart by spheres **15*a* welded between them. On the lower end of the column 10, there are also feet 19**, which allow the display apparatus to be free-standing.

Figure 3:
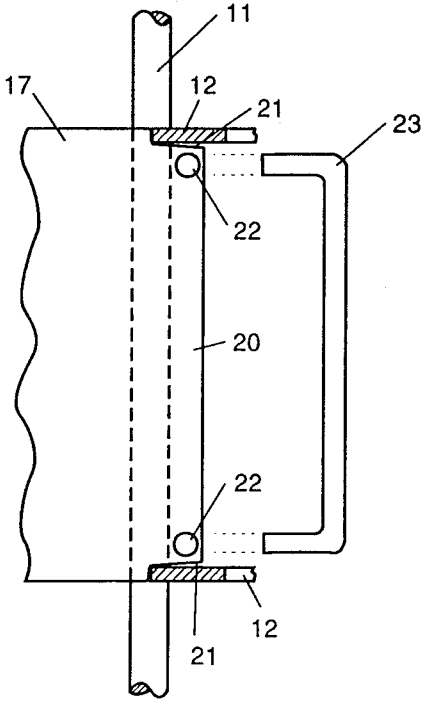
FIG. 3 shows a fastener element to fasten a panel.

FIG. 3 shows the fastener element provided for a panel 17 on the column 10. For this purpose, the panels 17 are designed in the area in which they are engaged between two round bars 11 so that their thickness, or depth dimension, corresponds to the distance between the round bars 11.

A lateral extension 20 of the panels is engaged between neighboring perforated discs, with a height which corresponds to the distance between two perforated discs 12, whereby the panels on the top and bottom have a graduated recess 21, which improves the lateral guidance and support of the panels between the perforated discs 12.

In the area behind the round bars 11, there are holes 22, into which a safety strap 23 can be inserted, which prevents the panels from falling out.

Figure 4:
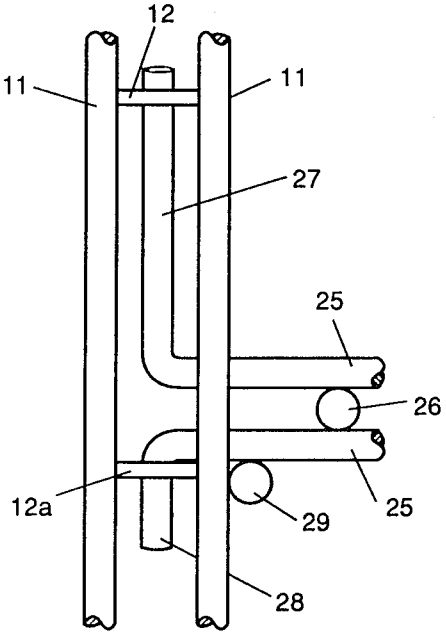
FIG. 4 shows a fastener element to fasten a merchandise rack or a connecting element.

Another simple configuration of a fastener is shown in FIG. 4. This fastener can be used for merchandise racks which are constructed of round bars 25, running parallel to one another, with spheres 26 welded between them. The free ends of the round bars 25 are bent at right angles up and down and are of different lengths, whereby the distance between the two ends of the bent round bars is greater than the distance between the perforated discs. The diameter of the round bars corresponds to the diameter of the hole in their perforated disc 12. To insert the fastener element, the longer free end 27 is inserted from below through a perforated disc, and pushed upward until the shorter free end 28 is introduced between the round bars 11 and can be inserted into the lower perforated disc **12*a*. A grid strap 29 attached at a certain distance from the lower free end 28 is in contact with the two corresponding round bars 11**, and holds the fastener element in the correct position so that it cannot be twisted.

FIG. 5 shows a contact plate 30 like the one used for another embodiment of a fastener element. The contact plate 30 has a corrugation and has a stamping or protrusion 31, the width of which is adapted to the distance between the round bars 11 of the column 10.

In the central area of the plate 30 there is a slot 32, through which a clamp part 33, shown in FIG. 6, can be inserted. The clamp part 33, shown in FIG. 6, is the same as that shown in a view from the left of the same clamp part 33 shown in an overhead view in FIG. 7.

The overhead view shown in FIG. 7 shows that a leg 35 runs diagonally over the clamp part 35, which has a threaded hole 36 in its central area. To the right and left of the diagonal leg 35, there are graduated surfaces 37. The graduated surface transitions have rectangular or quarter-circle shapes. This clamp portion is inserted through the slot 32 for fastening the contact plate to the column. To fasten the contact plate to the column, it is placed between two perforated discs 12 from outside on the round bar 11, whereby the rims 39 of the contact plate 30 run along the round bars 11, and the stamping 31 between them engages and sits on the lower perforated disc **12*a***.

FIG. 8 shows such a fastener element in the assembled position, whereby the typically round bars 40 and 41 of a connecting element are welded to the contact plate 30. After the contact plate 30 is installed, the clamp part 33, inserted through the slot 32, is rotated until the graduated surfaces 37 on the reverse, run along the round bars 11. By turning the screw 38 inserted in the threaded hole 36, the clamp part is pressed against the contact plate 30 and thus, the fastener element is fixed to the column 10.

Another embodiment of the invention relating to a fastener element is shown in FIG. 9, which is used primarily for merchandise racks which can be installed and replaced rapidly. The fastener element comprises a plate 45, which is welded on one side to the rods 40 and 41 of a merchandise rack, and is bent in a semicircular fashion on the opposite side, whereby the radius of curvature corresponds to the radius of the round bar 11. This bending results in a semicircular mounting 46, which has a horizontal edge on the lower end, by means of which the plate 45 is in contact with the perforated disc 12. The front edge of the semicircular mounting is provided with a projection 48, which is oriented so that the fastener element, when inserted, is in contact with the perforated disc 12 and is engaged with the projection 48 over the outer edge of the corresponding perforated disc 12. The fastener element is thereby rigidly and securely fixed to the column.

Another embodiment of a fastener element by means of which a very rigid and solid connection with the column 10 can be achieved is illustrated in FIGS. 10–13. This fastener element shown in FIG. 10 has a contact plate 50, the bottom part of which is similar to or corresponds to the contact plate 30, as shown in FIG. 5, and which is provided with a upward extension 51. This extension 51 is U-shaped, whereby the legs 52 are at a distance from one another, which corresponds to the distance between two neighboring round bars 11 of the column 10.

Figure 12:
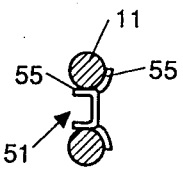
FIG. 12 shows a lateral view of two neighboring round bars into which a contact plate, as shown in FIG. 10, is inserted.

There is a slot 54 in the base leg 53 of the extension. When this contact plate 50 is placed against the round bar 11 of a column 10, the U-shaped extension is engaged between the round bars, and the outer rims 55 are in contact from the outside with the round bars. This position is illustrated in FIG. 12.

Figure 11:
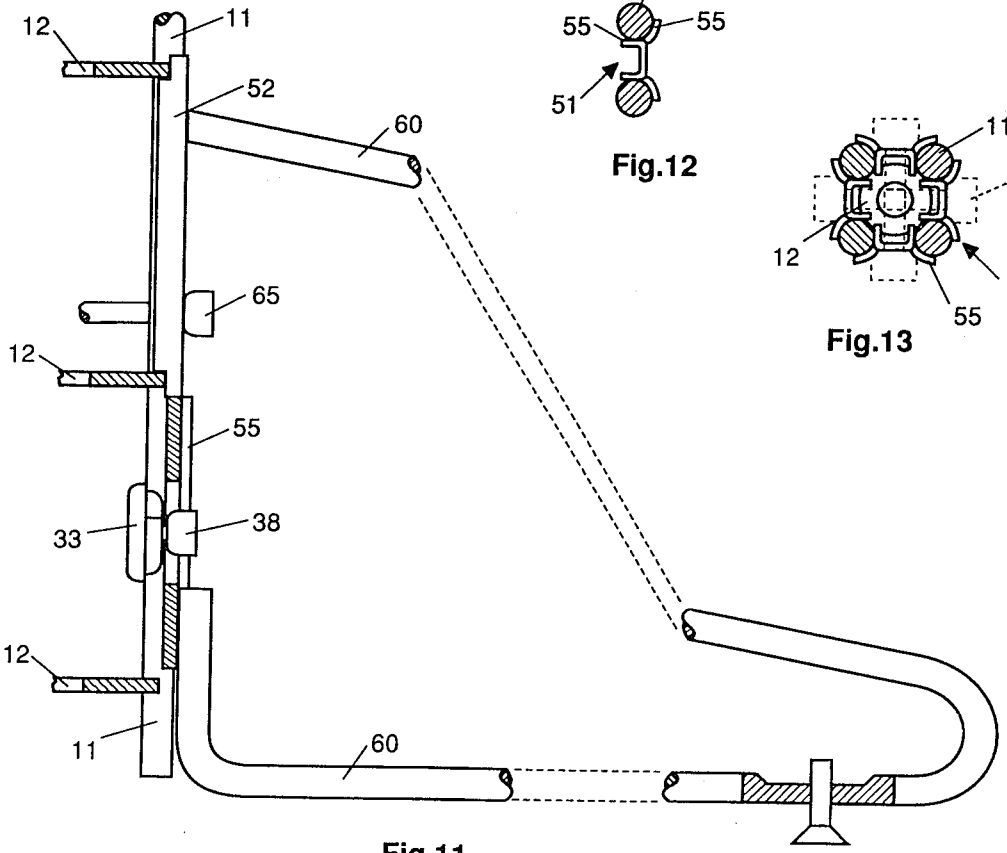
FIG. 11 shows a partial view of a frame foot with a contact plate as shown in FIG. 10.
Figure 10:
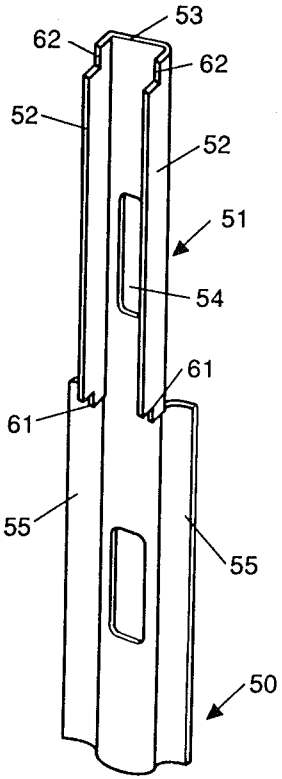
FIG. 10 shows an extended contact plate for fastening the frame feet.

The above-mentioned contact plate 50 is particularly advantageous, e.g., to fasten frame feet strongly to the column 10. Such a frame foot is illustrated in FIG. 11 and comprises a wire strap 60, which has the curve shown in FIG. 1 for the stand foot 19, and which is welded with its upper end to the extension 51 and with its lower end to the contact plate 50. The length of the contact plate with the extension equals twice the distance between the perforated discs. The contact plate installed on the column is engaged with the stamping between the rims 55 and the extension 51 between the round bars 11, whereby the extension is in contact with a recess 61 on the middle perforated disc. The vertical position is thereby fixed. With corresponding recesses 62 on the upper side of the extension 51, the latter is engaged on the top perforated plate, which makes certain that the extension cannot be forced between the round bars under load.

Figure 13:
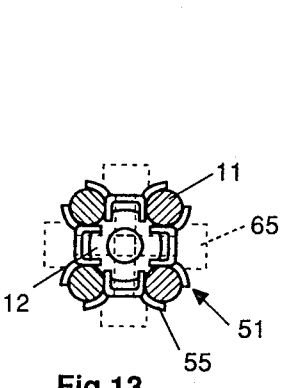
FIG. 13 shows a section through a column with four contact plates, as shown in FIG. 10, fastened to it.

To attach the contact plate to the column 10, there is a clamp part 33, as shown in FIG. 6, which in the manner described above, braces the contact plate 50 with column 10. To further protect and provide rigidity, there are other screws 65, which are inserted through the upper slot 54 and, as shown in FIG. 13, two extensions 51 across from one another are connected with one another and the extensions are braced with the round bars of the columns. This bracing is provided by the fact that the outer rims, when the screws 65 are tightened, press from outside against the rounds bars 11, and the extensions penetrated by the other screws are clamped between two round bars. The result is a very rigid and solid connection.

However, since the extension 51 is in contact above and below with the recesses 61 and 62 on the corresponding perforated discs 12, it makes certain that the round bars of the column are not undesirably distorted.

Figure 14:
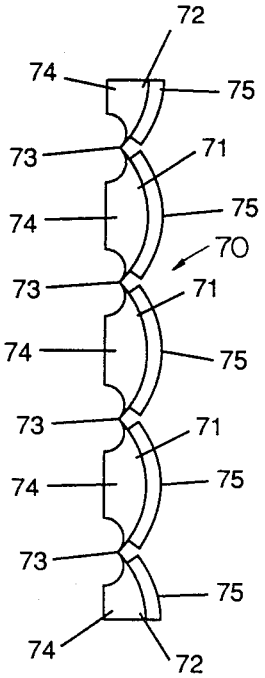
FIG. 14 shows an overhead view of a cylindrical sleeve.
Figure 15:
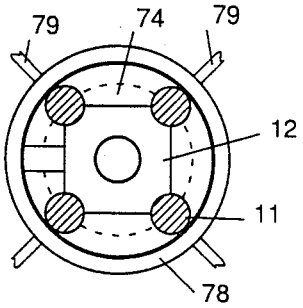
FIG. 15 shows a section through a column with a cylindrical sleeve in place and a cylindrical bushing of a rotating merchandise rack (not shown) mounted on it.

FIG. 14 shows a folded-up cylinder sleeve 70, which consists of three quarter-circle segments 71 and two eighth-circle segments 72. The segments 71 and 72 are connected to one another by film hinges 73, such as, thin plastic hinges. Between each two neighboring film hinges, are segments provided with projections 74, which extend forward enough so that, after the installation of the cylinder sleeve on the column 10, it lies on a perforated disc. Finally, on the outside bottom edge of the cylinder sleeve, there is a contact rim or flange 75. This cylinder sleeve, as shown in FIG. 15, is placed around the column 10, whereby the projections 74 are engaged between the round bars 11. These projections are in contact with a perforated disc 12, whereupon the vertical position is fixed. A cylinder bushing 78 pressed onto the cylinder sleeve 70 from above, is in contact with the flange 75, and can be rotated on the cylinder sleeve 70. As shown in FIG. 1, the cylinder bushing 78 can be connected by means of spokes 79 with the merchandise rack 80, which consists in turn of two round bars running parallel to one another, and which are held apart by spheres **15*a*** welded between them.

If it must be assured that the rotating merchandise racks cannot be removed from above, two cylinder sleeves can be used, the upper one of which is installed from the top after the insertion of the cylinder bushing. To anchor it firmly to the column, a threaded rivet can be inserted in the center hole of the perforated disc 12, into which a screw (not shown) is screwed by means of which a conical spring washer is braced from above on the projections 74 lying against the perforated disc.

By means of the threaded rivet inserted in the center hole of the perforated disc, bottom washers and conical spring washers can also be inserted on the top and bottom ends of the column 10. They can be adjusted by means of a threaded bolt into the threaded rivet. When such bottom washers and conical springs are used, the threaded rivet is appropriately inserted in the second perforated disc, while the first perforated disc serves as a guide for the threaded bolts.

The structure of the column also means that the display apparatus can be designed in colors, by inserting colored bars (not shown) through the holes in the perforated discs 12, to make the color scheme of the columns more attractive. Strip lights can also be pulled through the holes of the perforated discs 12, and can also be continued through to the connecting elements and display racks. This achieves a particularly effective and attractive visual impression.

Since such lights constructed in tubular form are very flexible, it is possible to form the strip light into any desired shape with no problem.

Figure 16:
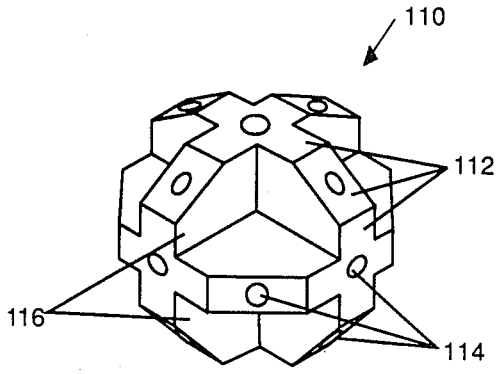
FIG. 16 shows a polyhedron with eighteen fastening planes uniformly distributed over the surface.

Now turning to an alternative embodiment of the invention, a polyhedron 110 shown in perspective in FIG. 16 has a total of 18 fastening planes, which are arranged in three cutting planes perpendicular to one another, whereby there are eight fastening planes distributed uniformly over the circumference, all in the cutting plane. In each fastening plane 112, there is a threaded hole 114, which is oriented toward the center of the polyhedron 110. The polyhedron is also provided with eight recesses lying between the fastening planes, whereby the boundary surfaces of the recesses running parallel to the three planes are also perpendicular to one another.

Figure 17:
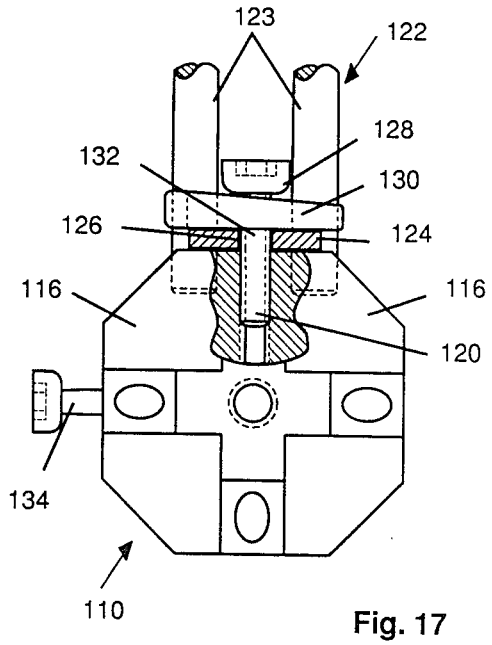
FIG. 17 shows a view of the polyhedron node with a rod bundle fastened to it.

FIG. 17 shows a polyhedron 110, to which a rod bundle 122 is fastened. This rod bundle consists of four round rods, which are fastened at intervals of 90° along the circumference of perforated discs 24, whereby the perforated discs are welded at certain intervals over the length of the rod bundle with the round rods, and thus, impart the desired static strength.

Figure 19:
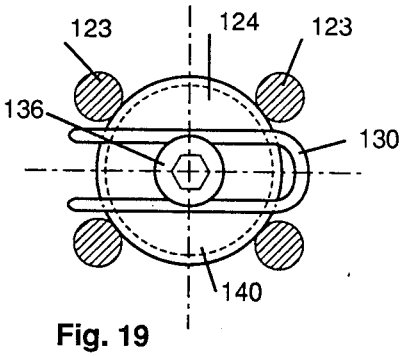
FIG. 19 shows a section along line IV—IV in FIG. 18.

If a rod bundle 122 is to be fastened to the polyhedron, the rod bundle is placed with the terminal perforated disc 124 on a fastening plane 112, whereby the ends of the round rods 123, which are preferably chamfered, are engaged in the recesses 116. A cap screw 120 inserted in the polyhedron projects through the central hole 126 of the perforated disc 124, whereby the cap 128, of the screw lies at a distance from the perforated disc 124, which corresponds to the width of a wedge-shaped profile 130. This wedge-shaped profile which, as shown in FIG. 19, is bent in the shape of a "U", is inserted between the perforated disc 124 and the cap 128 of the cap screw 120, whereupon the perforated disc is braced against the polyhedron. As a result of this wedging and the engagement of the ends of the round rods in the recesses 116, a very strong and rigid connection is achieved, which is able to absorb large transverse forces, in particular, if the recesses are sized so that the round rods are in contact with the lateral boundary surfaces. The cap screw 120 is provided with a collar 132 at a distance from the screw cap, whereby this distance is somewhat larger than the wedge distance. The thickness of the collar 132 corresponds to the diameter of the screw cap 128, so that, the rod bundle with the terminal perforated disc can be placed over the screw cap 128 and the collar 132.

Since the collar 132 is thinner than the perforated disc, a secure separation between the perforated disc 124 and the screw cap 128 is guaranteed when the profile with the wedge-shaped legs 130 is inserted. Instead of the cap screw 120, a cap screw 134, as shown in FIG. 17, can also be used with no collar 132. The strength of the connection is not thereby adversely affected, but the cap screw 134 must be precisely positioned when a profile with wedge-shaped legs is inserted, to guarantee the desired bracing. It is also possible, however, to use a profile made of a band, strip or sheet material being bent into a U-shape with such a cap screw 134, where the legs of the profile are not wedge-shaped.

Figure 18:
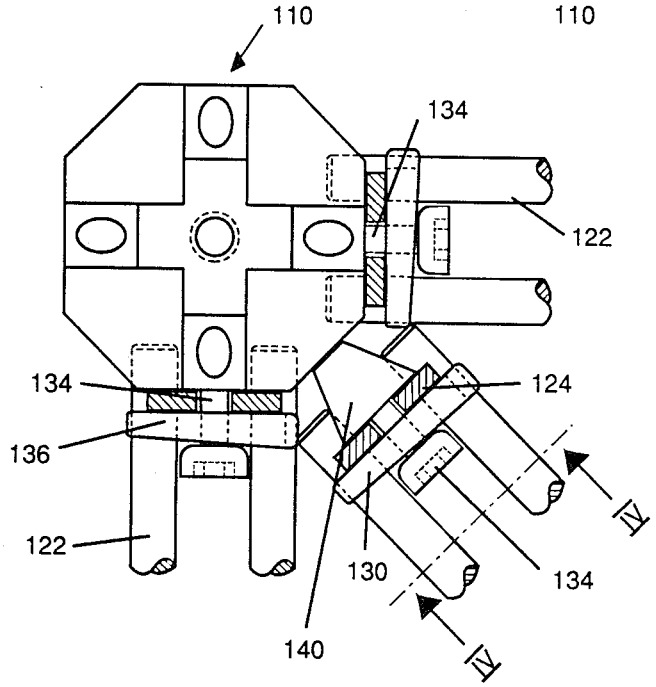
FIG. 18 shows another view of the polyhedron node with three rod bundles fastened to it.

Such a solution is indicated in FIG. 18, which shows two rod bundles fastened at right angles to one another on the polyhedron. In this embodiment, a cap screw 134 without a collar and a profile 136 with non-wedge-shaped legs are used. The cap screw 134 is designed as an Allen screw, so that, by means of a special wrench, after the assembly of the polyhedron and the rod bundle, the cap screw can be braced against the profile and thus, the rod bundle against the polyhedron. Since the special wrenches, which are themselves part of the prior art, make possible not only a partial rotation, but a full rotation, or a rotation of the cap screw by more than a full turn. This simplified embodiment of the invention also makes possible a secure bracing of the individual parts in relation to one another.

Figure 20:
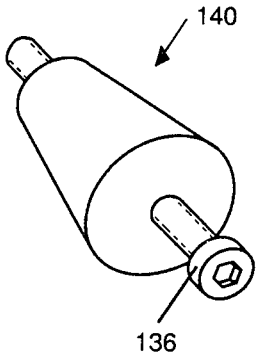
FIG. 20 shows a perspective view of an intermediate cone.

FIG. 18 also shows the fastening of a third rod bundle at an angle of 45 degrees to the other rod bundles on the polyhedron. For this purpose, an intermediate cone is used, which is designed either as one piece with the cap screw, or it can be pushed onto a cap screw 136 with a rather long shaft. This intermediate cone 140 is screwed into the hole 114 of the polyhedron, and makes it possible to fasten a third rod bundle with the perforated disc 124 at a greater distance from the polyhedron, so that, the individual round rods of the neighboring rod bundle do not interfere with one another. The separation or bracing of the intermediate cone 140 on the perforated disc 124 is done in the manner described above, whereby the cap screw 136 is screwed into the intermediate cone 140 or through the intermediate cone 140 into the polyhedron. FIG. 20 shows an intermediate cone 140 in perspective, in which the cap screw 136 is screwed into the intermediate cone. On the underside of the intermediate cone, a threaded stem is attached as a single piece, by means of which the intermediate cone is fastened to the polyhedron.

FIG. 19 shows a section along Line IV—IV in FIG. 18, which shows the arrangement of the four round rods of the rod bundle in relation to the perforated disc 124. The figure also shows the cap of the screw 136, by means of which the profile 130 is braced against the perforated disc 124.

Figure 21:
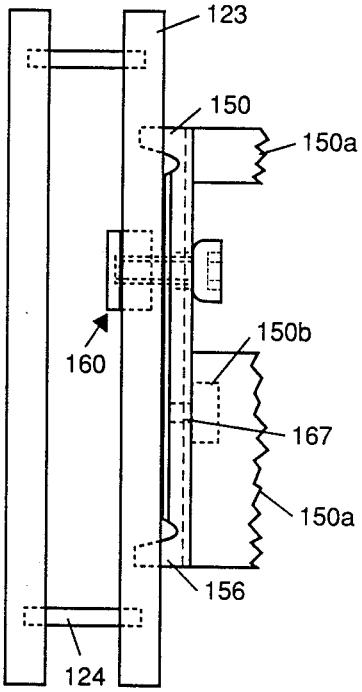
FIG. 21 shows a side view of a connecting element for brackets on rod bundles.
Figure 22:
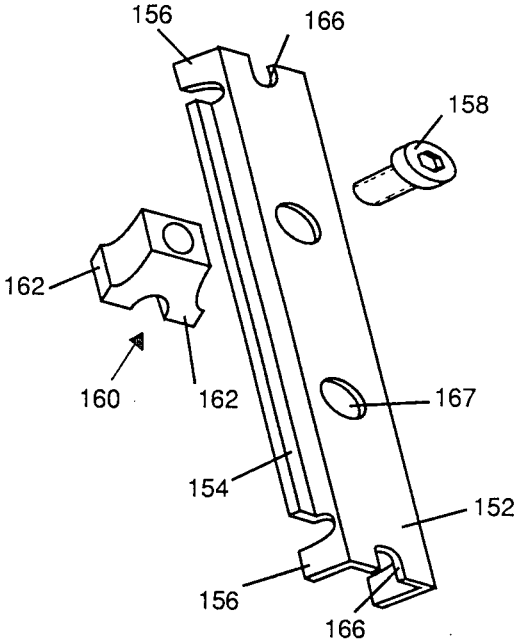
FIG. 22 shows an exploded perspective view of the connecting element shown in FIG. 21.

Finally, FIGS. 21 and 22 illustrate another embodiment of a connecting element 150 like that used to fasten brackets to a rod bundle consisting of round rods. In this embodiment, a bracket **150*a* is not shown in great detail, but which it is either suspended from or rigidly mounted on the connecting element 150**.

The connecting element 150 comprises a U-shaped bent rail 152, whose legs are bent outward at right angles in the central area. The terminal segments 156 of the U-shaped rail are engaged between the neighboring round rods 123 of a rod bundle, whereby the central areas 154 bent outward at right angles are in contact from the outside with the round rods 123, as shown in the side view of FIG. 21.

A cap screw 158, engaged through the base plate of the rail 152, is screwed into a clamp 160, which is engaged with rounded projections 162 behind the rods, and can be braced by means of the cap screw 158 against the connecting element 150.

To insert the connecting element, the clamp 160 is oriented in the longitudinal direction of the rail 152 and is pushed through together with it between two neighboring round rods. By turning the cap screw 158, the clamp penetrated by the two neighboring round rods also turns, since the clamp is rounded on two edges opposite one another, so that, a space results which is smaller than the space between the round rods. The other two edges opposite one another are narrower, and have a diagonal distance which is greater than the distance between the round bodies, which results in a locking when it is clamped, so that, the clamp body can rotate no farther than its limit position used for clamping.

The rail 152 is provided on the lower and upper end with U-shaped segments 166, through which projections from the bracket, such as, screw or rivet heads (not shown) on the braket **150*a*, and also has a hole 167 in the base plate, through which a bracket 150*a*, not shown in detail, and suspended on the rail 152, can be bolted with a bolt 150*b* firmly to the rail 152 through the hole 167**. This connecting element offers the possibility of positioning brackets in almost any desired position along a rod bundle, and thus, the possibility, in connection with the polyhedron, of constructing display stands which can meet the most varied requirements of merchandise display.

The invention as described hereinabove in the context of the preferred embodiments is not to be taken as limited to all of the provided details thereof, since modifications and variations thereof may be made without departing from the spirit and scope of the invention.

What is claimed is:

1. A modular system for the erection of apparatus for the display of merchandise, said modular system comprising:

at least one column for being supported by a base;

said at least one column having a longitudinal direction;

said at least one column including four parallel, round bars extending in said longitudinal direction;

said at least one column having a plurality of more than two discs disposed transversely of said longitudinal direction within and fastened to said bars;

each of said discs being circular and having a predetermined diameter;

said bars being disposed equally about each of said discs with an angle of about 90 degrees therebetween;

said plurality of discs being distributed at substantially uniform intervals one from the other in said longitudinal direction along a length of said column to provide support for and rigidity to said bars throughout said length of said column; and at least one member including connecting means for connecting said member to at least one of said bars and said discs of said at least one column said connecting element for being deposed at said end of said column between said bars extending beyond said at least one of said discs and for being interlocked with said connecting element for preventing any substantial rotation between said connecting element and said column.

2. The modular system according to claim 1, wherein said discs are fastened to said bars at an interval of approximately 10 cm, one from the other.

3. The modular system according to claim 1, wherein said at least one column is one of a plurality of said columns, said member being for connecting said columns, said member comprising a contact plate, said contact plate having said connecting means disposed thereon, said connecting means comprising a clamp part for engagement behind two adjacent said bars between adjacent said discs and means for bolting said contact plate against the bars, said connecting means further comprising a projection extending from said contact plate.

4. The modular system according to claim 1, wherein said means for connecting comprises a plate for surrounding one of said round bars, said plate having front edges, said discs having outer edges, said plate having lower end surfaces for making contact with one of said discs, and said plate having a projection on one of its front edges for engaging an outer edge of its corresponding disc.

5. The modular system according to claim 1, wherein said member includes a connecting panel, said connecting panel having a thickness corresponding to a lateral distance between two adjacent said round bars, said connecting means comprising a lateral extension on said connecting panel having an edge for being inserted between said two adjacent round bars and two adjacent said discs.

6. The modular system according to claim 5, wherein the lateral extension for insertion inside the column is provided with two holes for insertion of locking means, said locking means being disposable to be in contact with the round bars.

7. The modular system according to claim 1, wherein at least some of said discs include a hole therethrough, said means for connecting comprises round elongated means of different lengths being disposed parallel to the longitudinal direction of the column which elongated means are insertable into the holes of the discs and a grid strap being disposed on said member outside the column and in contact with two adjacent said round bars at the outside thereof.

8. The modular system according to claim 3, wherein the contact plate has a U-shaped curved extension extending therefrom, said extension being disposed to make contact at least on the top thereof with a circumferential portion of one of said perforated discs, said U-shaped extension being engaged between said two adjacent round bars, said U-shaped extension having a base leg with at least one hole for receiving a bolt for bolting the extension to its corresponding column.

9. The modular system according to claim 1, wherein said at least one member comprises at least one rotating merchandise rack, said means for connecting comprising a multi-segment cylinder sleeve provided with support means, said cylinder sleeve having individual parts, said individual parts being connected with one another in the vicinity of the round bars by means of film hinges, said sleeve having projections between each two neighboring film hinges, said projections extending inwardly on its corresponding column above and being supported by an adjacent one of said perforated discs, and a cylinder bushing being connected to the rotating merchandise rack being mounted to be rotatable on the cylinder sleeve.

10. A modular system for the erection of apparatus for the display of merchandise, said modular system comprising:

at least one column for being supported by a base;

said at least one column having a longitudinal direction;

said at least one column including four parallel round bars extending in said longitudinal direction;

said at least one column having a plurality of more than two discs-disposed transversely of said longitudinal direction within and fastened to said bars;

each of said discs being circular and having a predetermined diameter;

said bars being disposed equally about each of said discs with an angle of about 90 degrees therebetween;

said plurality of discs being distributed at substantially uniform intervals one from the other in said longitudinal direction along a length of said column to provide support for and rigidity to said bars throughout said length of said column;

at least one of said discs being disposed near an end of said column and including a hole in a center thereof;

said bars extending beyond said at least one of said discs at said end of said column;

a connecting element for connecting said end of said column to another object; and said connecting element for being deposed at said end of said column between said bars extending beyond said at least one of said discs and for being interlocked with said connecting element for preventing any substantial rotation between said connecting element and said column.

11. The modular system according to claim 10, wherein said connecting element comprises a polyhedral shaped element having a plurality of first surfaces;

said element having a plurality of at least six threaded holes respectively disposed in said plurality of said first surfaces;

said polyhedral shaped element defining three planes therein being perpendicular to one another;

said threaded holes having longitudinal axes;

each of said threaded holes being disposed with its longitudinal axis in two of said three planes;

each threaded hole having an inner end and an outer end;

each threaded hole being disposed in one of said surfaces;

each of said surfaces having said thread hole disposed therein being substantially perpendicular to said outer end of said threaded hole;

said polyhedral shaped element having eight recesses;

four of said recesses being disposed adjacent each said threaded hole and adjacent said surfaces at the outer end of said each threaded hole;

said bars being disposed a given distance one from the other;

portions of said eight recesses being disposed from one another at substantially the same distance as said given distance between said bars;

at least one cap screw for insertion through said hole in said at least one of said discs and for insertion into one of said threaded holes; and said bars at said end of said column extending beyond said at least one of said discs for engagement into said four of said recesses of said polyhedral shaped element.

12. The modular system according to claim 11, further including a profile disposed between a cap of said cap screw and said at least one of said discs.

13. The modular system according to claim 12, wherein said profile comprises a strip of material bent into a U-shape.

14. The modular system according to claim 13, wherein said material bent into a U-shape has legs, said legs being wedge-shaped.

15. The modular system according to claim 12, wherein the cap screw has a collar having a portion disposed at a given distance from said cap of said cap screw, said portion of said collar being disposed a distance from its corresponding said surface on the element.

16. The modular system according to claim 11, wherein said polyhedral element has twelve additional fastening surfaces, each of said additional fastening surfaces is perpendicular to one of said three planes and extends at an angle of about 45 degrees uniformly between two adjacent ones of said first surfaces, said another element is an additional column similar to said at least one said column, said additional column being disposed to be fastened to at least one of the additional fastening surfaces, and further including intermediate cone means being inserted between said at least one disc at said end of said additional column and its corresponding said additional fastening surface.

17. The modular system according to claim 16, further including additional threaded holes disposed at each of said twelve additional surfaces, said cone means having a larger diameter end and a smaller diameter end, an additional cap screw being screwed into said larger diameter end of said cone means for securing said end of said additional column thereto, and said cone means having a threaded stem on said smaller diameter end which is screwed into said additional threaded hole of said corresponding additional fastening surface.

18. The modular system according to claim 1, wherein said member includes a screw with a screw cap, a clamp means and a U-shaped rail, said U-shaped rail having legs and a center region and U-shaped terminal segments, said legs of the U-shaped rail being bent outward at right angles in its center region, the U-shaped terminal segments of the U-shaped rail being engaged between two adjacent ones of the round bars, and the legs of the U-shaped rail being in contact with the adjacent round bars on an outside portion thereof, said center region of said U-shaped rail comprising a base plate, the cap screw engaging the U-shaped rail through an aperature in the base plate, said screw being engaged in said clamp means, and said clamp means being disposed to clamp from inside the column to clamp against an inside portion of the round bars.

19. The modular system according to claim 18, including a bracket being attached to the rail.

20. The modular system according to claim 19, wherein said bracket is rigidly fastened to the rail.

21. The modular system according to claim 19, wherein said bracket is removably suspended in the rail.

22. The modular system according to claim 19, wherein said base plate of the rail at the ends having said U-shaped segments includes openings for insertion of the bracket and further includes an additional fastening hole through which the bracket can be rigidly connected to the base plate.

* * * * *